US005318110A

United States Patent [19]

Wei

[11] Patent Number: 5,318,110

[45] Date of Patent: Jun. 7, 1994

[54] HEAT EXCHANGER HAVING INTERNALLY COOLED SPACER SUPPORTS FOR HEAT EXCHANGE TUBES

[75] Inventor: William Wei, Munchen, Fed. Rep. of Germany

[73] Assignee: MTU Motoren-Und Turbinen-Union München GmbH, München, Fed. Rep. of Germany

[21] Appl. No.: 981,132

[22] Filed: Nov. 24, 1992

[30] Foreign Application Priority Data

Nov. 28, 1991 [DE] Fed. Rep. of Germany ..... 4139104

[51] Int. Cl.[5] ..... F28F 9/22

[52] U.S. Cl. ..... 165/145; 165/176

[58] Field of Search ..... 165/144, 145, 163, 176

[56] References Cited

U.S. PATENT DOCUMENTS

| | | | |
|---|---|---|---|
| 2,013,187 | 9/1935 | Price | 165/144 |
| 3,112,793 | 12/1963 | Sass | 165/175 |
| 3,376,917 | 4/1968 | Fristoe et al. | 165/145 |
| 4,809,774 | 3/1989 | Hagemeister | 165/163 |
| 5,037,955 | 8/1991 | Dighton et al. | 165/145 |
| 5,042,572 | 8/1991 | Dierbeck | 165/145 |
| 5,131,459 | 7/1992 | Thompson et al. | 165/145 |

FOREIGN PATENT DOCUMENTS

| | | |
|---|---|---|
| 265726 | 9/1990 | European Pat. Off. . |
| 389759 | 10/1990 | European Pat. Off. . |
| 331026 | 5/1992 | European Pat. Off. . |
| 3942022 | 6/1991 | Fed. Rep. of Germany . |

*Primary Examiner*—John Rivell
*Assistant Examiner*—L. R. Leo
*Attorney, Agent, or Firm*—Ladas & Parry

[57] ABSTRACT

Spacer supports are connected to a matrix of heat exchange tubes of a heat exchanger to maintain the heat exchange tubes in spaced relation and resist overheating by hot fluid flowing around the tubes and the spacer supports. The spacer supports are in the form of hollow tubular bodies in which the heat exchange tubes are supported in spaced relation. The heat exchange tubes communicate with the interior of the hollow bodies so that flow of a heatable fluid in the heat exchange tubes is conveyed through the hollow body to wet the interior thereof and cool the same.

25 Claims, 4 Drawing Sheets

HEAT EXCHANGER HAVING INTERNALLY COOLED SPACER SUPPORTS FOR HEAT EXCHANGE TUBES

FIELD OF THE INVENTION

The invention relates to a heat exchanger particularly for use as an air cooler for hypersonic engines.

The invention relates more particularly to spacer support means for heat exchange tubes of the heat exchanger.

The invention is especially applicable to a heat exchanger of the type having first and second spaced manifolds for the supply and discharge of a heat absorbing fluid and a matrix of heat exchange tubes connected to said first and second manifolds for conveying the heat absorbing fluid therebetween, said matrix of heat exchange tubes being disposed in the path of a fluid for heat exchange between said fluid and the heat absorbing fluid conveyed in the heat exchange tubes.

The invention is particularly concerned with the construction and arrangement of spacer support means connected to the heat exchange tubes of the matrix to maintain the tubes in spaced relation.

BACKGROUND AND PRIOR ART

Heat exchangers of the above type, especially of cross-counterflow construction, have been disclosed in EP-A-0331 026 and EP-A-0265 726. Heat exchangers of this type of crossflow construction are disclosed in US-A-3, 112, 793 where the tube matrix extends in a straight, undulating or diagonal arrangement between the respective main ducts or manifolds conveying the fluid to be temperature controlled. These heat exchangers can be used as exhaust gas heat exchangers or recuperators, where the tube matrix is arranged in the hot exhaust gas stream of a stationary or propulsion gas turbine engine and where a portion of the heat contained in the hot exhaust gas stream is used to heat compressed air for the combustion chamber in its passage through the tube matrix before reaching the combustion chamber.

Also discussed in DE-A-39 42 022, is the use of heat exchangers of crossflow or cross-counterflow construction as cooling air coolers (condensers) in hypersonic engines, where cooling air tapped at the intake end at a point upstream of the basic engine's compressor is liquified by, among other means, heat exchange with cryogenically fed fuel, such as hydrogen, and conveyed in its vaporous state to components requiring cooling.

In straight ramjet operation (hypersonic flight) the compressed ram air ducted to the ramjet engine through a variable air intake reaches temperatures of approximately 1500° K and above, which exposes the tube matrix of the heat exchanger, when used as a cooling air cooler, to extremely high temperatures.

In all of the above-cited uses, the tube matrix and the necessary supports of the tubes of the matrix are subjected to correspondingly elevated temperatures. Perforated plates heretofore used as spacer supports are substantially unusable in this environment because they lack the required strength, rigidity, oxidation resistance and the like. The perforated plates also have the disadvantage of producing vibration-induced cracks at the perforations for the tubes which tend to render the plates unserviceable relatively early in their life. It has been proposed to provide spacer supports with metal felt strips, or wires or tapes to dampen the vibration, but these are comparatively unstable from a stress aspect and practically lack resistance to elevated temperatures, as do the perforated plates themselves. Apart from their comparatively complex construction, they also require additional external support such as, supporting frames, housings and the like as evident from EP-A-0389 759.

SUMMARY OF THE INVENTION

An object of the invention is to provide a spacer support means for the tube matrix of a heat exchanger which avoids the disadvantages of conventional spacer support means and is capable of resisting extremely high temperatures while providing support for the heat exchange tubes of the matrix with minimized vibration.

A further object of the invention is to provide a spacer support means which is itself cooled by the fluid flowing in the heat exchange tubes of the tube matrix.

In order to satisfy the above and further objects, the invention contemplates a heat exchanger, particularly for use as a cooling air cooler for a hypersonic engine, having spacer supports for heat exchange tubes of a matrix connected to first and second spaced manifolds for conveying a heat absorbing fluid between the manifolds, the matrix of heat exchange tubes and the spacer supports being disposed in the path of flow of a high temperature fluid which exchanges heat with the heat absorbing fluid being conveyed in said heat exchange tubes. The spacer support means is hermetically sealed with respect to the external high temperature fluid and defines a hollow internal cavity through which the heat absorbing fluid passes to cool the spacer support means.

Consequently, the spacer support means not only supports the heat exchange tubes in spaced relation but it also conveys the heat absorbing fluid therethrough for cooling purposes.

The heat absorbing fluid can be, for example, compressed air or a liquid coolant such as liquid hydrogen, and by causing the fluid to flow through the tubes of the matrix and also through the space support means an "actively" cooled spacer support means is provided in the heat exchange cycle. The spacer support means is in the form of one or more hollow bodies which communicate with the interiors of the heat exchange tubes. Apart from its advantageous cooling effect, each hollow body practically represents an additional heat exchanger element, and by locally fixedly joining the tubes of the matrix, in rows, groups or bundles to the respective hollow bodies, especially by brazing or welding, a vibration-resistant spacer support means for the tubes of the matrix is provided Compared to the manifolds, the hollow bodies serving as the spacer support means are relatively small in size and can be designed and arranged aerodynamically in the path of flow of the high temperature fluid. For this purpose, the hollow bodies can be of an oblong or oval shape whose major axis is in the direction of flow of the high temperature fluid.

According to the present invention, the hollow body can have various shapes, for example, it can be of an annular shape such as an ellipse or circle or its walls can be rectilinear to form a polygonal outline. A multitude of cylindrical bodies can be provided to establish a relatively large heat transfer area. The polygonal outline or the multitude of cylindrical bodies may also be used to induce turbulence to control the local dwell times of the fluid (internally and externally alike) for optimum cooling of the spacer support means.

The hollow body used as the spacer support may have partitions defining separate cooling chambers, each communicating with respective rows or groups of matrix tubes. The provision of the partitions, especially also at highly thermally stressed ends of a tubular body confers maximum resistance of the body to temperature and minimum heat erosion by the hot gases at these ends.

The invention also contemplates spacing of the hollow bodies along rows or groups of matrix tubes such that differential thermally induced expansions of the matrix tubes in a direction transverse to the centerlines of the manifolds can be compensated in one plane of the spacer support. This can also be achieved by providing means on separate hollow bodies which permit relative transverse sliding movement thereof.

DETAILED DESCRIPTION OF PREFERRED EMBODIMENTS

Figure 1:
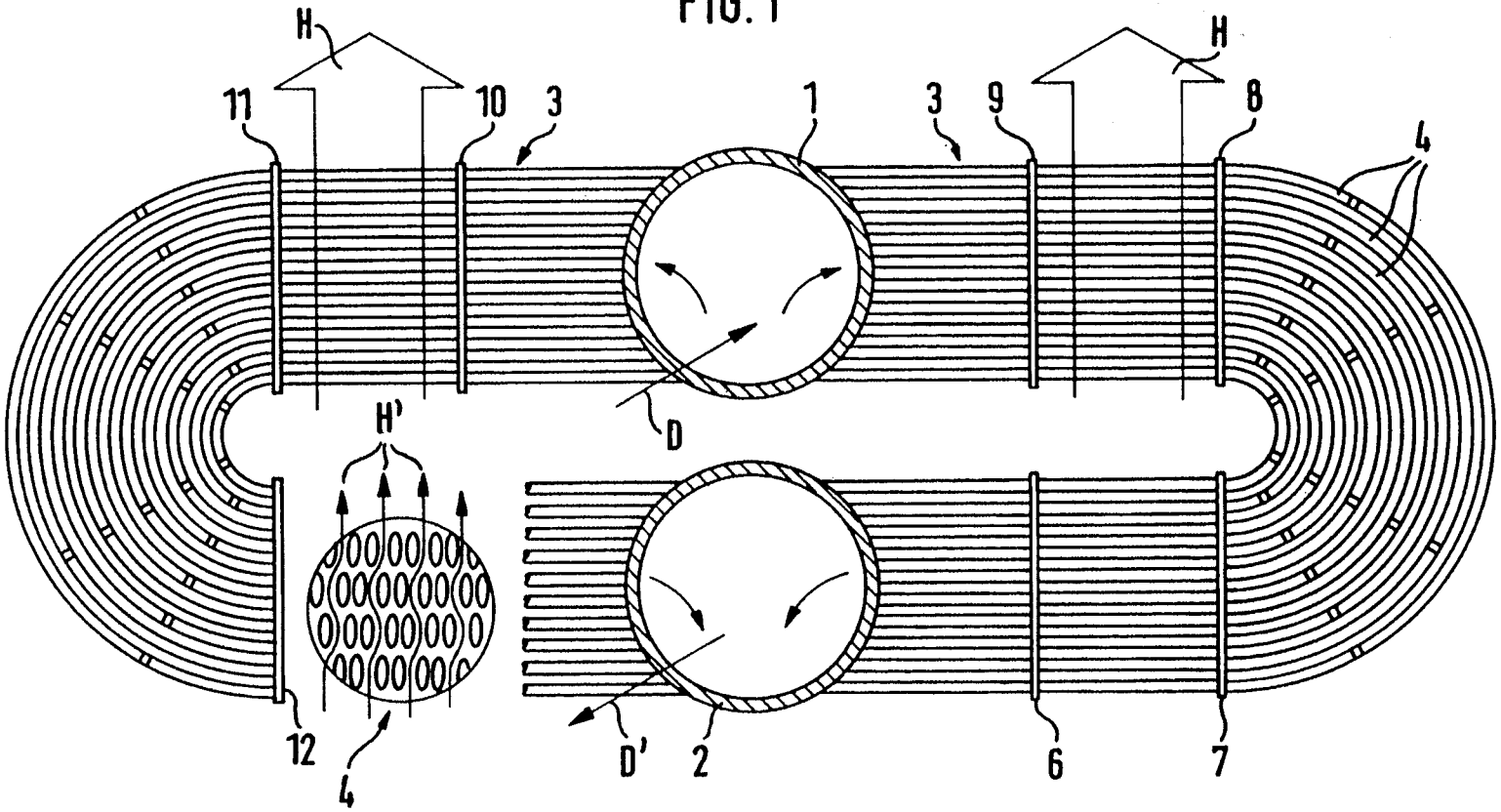
FIG. 1 is a diagrammatic illustration, partly in section, of a heat exchanger of cross-counterflow construction seen in end view.

With reference now to FIG. 1, therein is seen a heat exchanger of cross-counterflow construction comprising two spaced ducts or manifolds 1, 2 in parallel arrangement. From opposite sides of the two manifolds 1, 2 U-shaped tube matrices 3 project into the flow path of a hot gas stream H. Each tube matrix consists of a multitude of individual heat exchange tubes 4 arranged in spaced relation in rows and columns as seen in the broken away section of the lower portion of matrix 3 at the left in FIG. 1. As also seen in this section, the heat exchange tubes 4 are of elliptical cross-section and the hot gas flows in undulating streams H' in an essentially sinuous course through the spaces between the tubes 4 of the matrix. In this arrangement the elliptical tubes 4 are positioned with their major axes in the direction of flow of the hot gas stream H.

In operation, compressed air D is supplied to the upper manifold 1 and flows laterally into the straight sections of each tube matrix 3. In the end, bend region of each matrix, the direction of compressed air flow is reversed and the compressed air travels through the lower, straight sections of the matrix 3 into the lower manifold 2, from where it is conveyed in a heated condition in the direction D' to a suitable utilization means (not shown) such as the combustion chamber of a gas turbine engine. The heat exchange tubes 4 of each matrix 3 are secured in spaced relation by spacer supports 6–12 disposed at various spaced locations along each matrix.

Depending on the prevailing structural conditions and in order to minimize aerodynamic losses, each matrix 3 can be arranged at an angle relative to the hot gas stream H, in which case the hot gas stream H would flow over the surface of the heat exchange tubes 4 at an angle relative to their longitudinal direction. This also applies to the use of such a heat exchanger as a cooling-air cooler, for example, when the tubes 4 of the matrix 3 are subjected to the flow of extremely hot ram air of a ramjet propulsion system, and instead of conveying compressed air at D as the heat absorbing fluid, liquid hydrogen or the like is supplied to the manifold 1 and after being heated by traveling through the tube matrix 3, the liquid hydrogen is converted to a vapor state and is discharged from manifold 2 at D', for example, to the combustion system of the ramjet propulsion system.

The invention is especially concerned with the construction of one or more of the spacer supports 6–12 and is characterized by providing a system for "actively" cooling the supports. In particular, a fluid such as compressed air, a cooling gas or a liquid coolant such as hydrogen is caused to flow through the spacer supports as it does through the heat exchange tubes 4, to absorb heat and thereby cool the spacer supports to prevent heat build-up and possible damage to the supports and the heat exchange tubes 4 connected thereto. For this purpose, the spacer supports are formed as hollow bodies and the fluid passing through the tubes 4 of matrix 3 is caused to pass through the hollow bodies to internally wet and cool the same.

Figure 2:
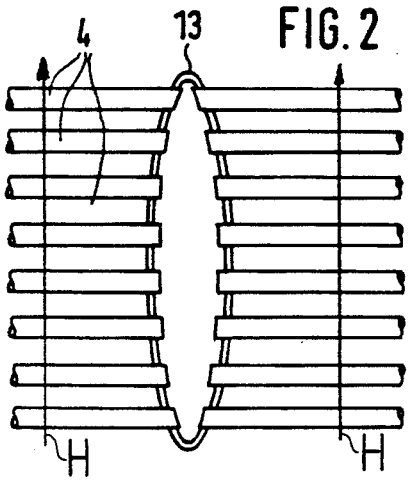
FIG. 2 is a diagrammatic sectional view of an oblong or oval hollow-body spacer support with matrix tubes fixedly connected thereto at both sides.

Referring to FIG. 2, therein is seen a spacer support in the form of a hollow tubular body 13 of oblong oval or elliptical cross-section. The tubular body 13 extends transversely of the tubes 4 of the matrix, i.e. parallel to the axes of ducts 1 and 2 over the entire width of the matrix or a portion thereof. This will be discussed in more detail later. The tubular body 13 is hermetically sealed with respect to the gas stream H. The heat exchange tubes 4 are sub-divided at the tubular body 13 and the ends of the sub-divided tubes are fixedly supported in openings provided in opposite side walls of the hollow body 13 so that the interiors of the sub-divided tubes communicate with the interior of the hollow body 13. Preferably, the ends of the sub-divided tubes 4 are brazed or welded to the body 13 at the openings depending on how well the joining temperatures can be controlled. As a result of this construction, the tubes 4 are sealed to the hollow body 13 and the fluid flowing in the tubes 4 passes into and through the hollow body 13 to cool the same.

In FIG. 2, eight rows of heat exchange tubes 4 are connected to hollow body 13 and the number of tubes which are connected in groups to the hollow body can be increased or decreased.

Figure 3:
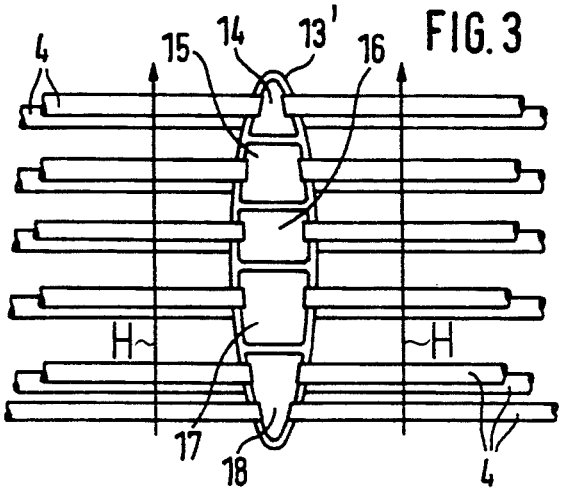
FIG. 3 is a modification of the arrangement in FIG. 2 in which several cooling chambers are provided in the spacer support.

In FIG. 2, the heat exchange tubes 4 open in common into the interior of the hollow body 13. FIG. 3 shows a variation in which hollow body 13' is provided with partitions dividing the hollow body into separate chambers 14–18 into which respective rows of heat exchange tubes 4 open. In FIG. 3 each row of tubes 4 has two staggered lines of tubes 4 which open into chambers 14–17, where as three staggered lines of tubes 4 open into chamber 18.

Figure 4:
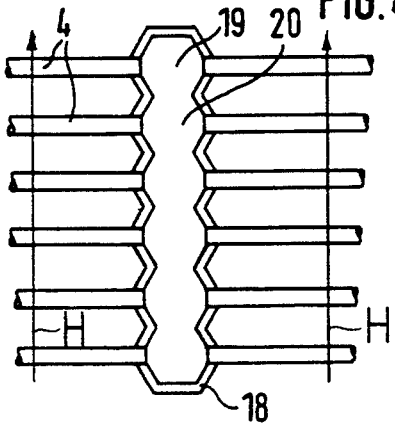
FIG. 4 illustrates another modification of the arrangement in FIG. 2.

FIG. 4 illustrates another variation of the hollow tubular body wherein the opposite facing walls of the hollow body include rectilinear portions to define a polygonal outline for the hollow body in which successive chambers, such as chambers 19 and 20 are formed which are polygonal in shape and merge with one another and into each of which one row of tubes 4 open. This arrangement tends to produce turbulence in the hot gas stream H flowing over the outside of the hollow body thereby promoting heat exchange with the fluid in the hollow body.

Figure 5:
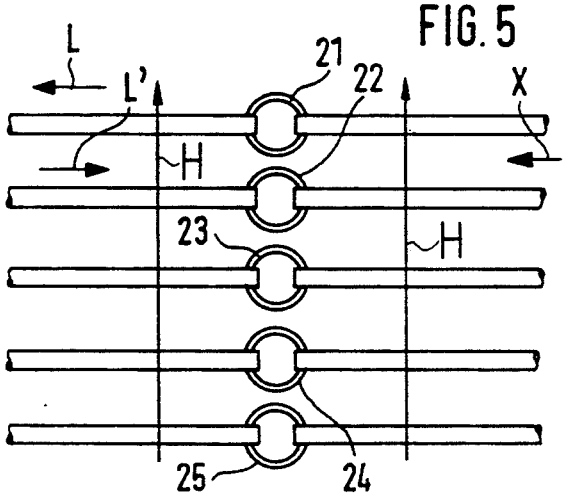
FIG. 5 illustrates another embodiment of a spacer support comprising a number of separate, hollow, cylindrical bodies with respective matrix tubes.

In the embodiment of FIG. 5 each row of heat exchange tubes cooperates with a respective cylindrical body 21–25. The cylindrical bodies 21–25 are arranged in spaced relation one above the other in a common plane extending transversely of matrix 3. Thereby, adjacent bodies such as bodies 21, 22 can balance thermally induced variations in the length L, L' of adjacent rows of heat exchange tubes 4.

Figure 6:
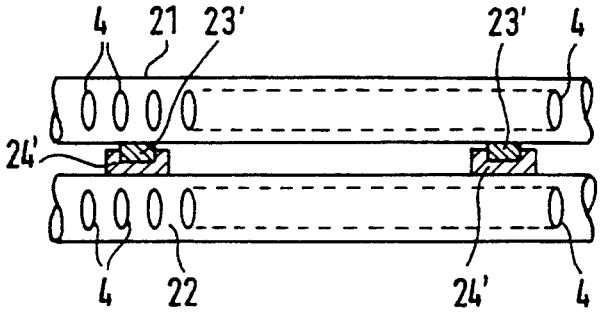
FIG. 6 is a modified arrangement of FIG. 5 seen in the direction of arrow X in FIG. 5.

In a variant of the arrangement in FIG. 5, two adjacent bodies of the spacer support, for example, the hollow bodies 21, 22 may be slidably supported relative to one another to accommodate changes in length L, L'. For this purpose, FIG. 6 shows a means coupling bodies 21 and 22 for relative transverse sliding movement comprising tongues 23' on body 21 slidably engaging in grooves provided in elements 24' on body 22.

Two or more of the embodiments of spacer supports illustrated in FIGS. 2 to 6 may be employed in combination in the heat exchanger.

Figure 7:
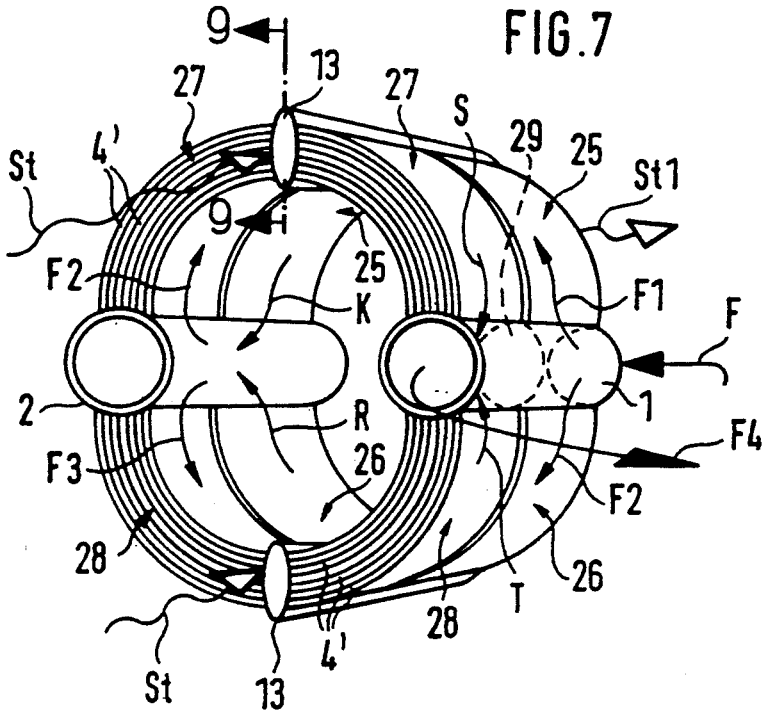
FIG. 7 is a diagrammatic perspective view of another embodiment of a cross-counterflow heat exchanger for use especially in the cooling of cooling air in a hypersonic engine.

FIG. 7 illustrates a cross-counterflow heat exchanger suitable for use on a hypersonic aircraft engine having an essentially annular arrangement of the tube matrix connected to the respective manifolds 1, 2 in the form of two subdivided semicircular segments 25 and 26; and 27 and 28. The longitudinal center line of the heat exchanger is coincident with the center line of the annular arrangement of the tube matrix illustrated in FIG. 7 and the center line extends substantially parallel to the engine center line. In FIG. 7, the spacer supports 13 are in the form of oblong oval tubular bodies (as in FIG. 2) and they are symmetrically positioned on opposite sides of the annular matrix. The manifold 1 in FIG. 7 contains a partition 29 dividing the manifold into two chambers. The manifold 2 is sealed with cover plates at its ends. In operation, the annular matrix (segments 25 to 28) is externally wetted by hot ram air flowing in a direction approximately parallel to the center line of the heat exchanger, the direction of hot ram air inlet flow being shown at St and the direction of cooled cooling air outlet flow at St 1. The cooled cooling air can then be conveyed by ducts to thermally highly stressed components requiring cooling. The tubular bodies 13 are "actively" cooled by the flow of coolant, such as, hydrogen, passing through the heat exchange tubes 4' of the matrix and through the hollow tubular bodies 13. The coolant vaporizes during the heat exchange process. For this purpose, the hydrogen is supplied to manifold 1 in the direction of arrow F in a liquid state, and the liquid hydrogen then flows in the directions of arrows F1 and F2, to the heat exchange tubes 4' of the segments 25, 26, from which the hydrogen flows into manifold 2 in the direction of arrows K and R. The hydrogen then flows from manifold 2 in the directions F2 and F3 (opposite the direction of arrows K and R) into segments 27, 28 and then into the second chamber of the manifold 1 in the direction of arrows S and T. From the second chamber, the hydrogen, now in its vaporized state, can be supplied, after suitable conditioning, in the direction of arrow F4, for example, to the fuel injection system of the ramjet combustion chamber. The heat exchanger may optionally be enveloped by a cylindrical, thermally insulated jacket; the annular tube matrix may be surrounded by a cylindrical jacket and be provided with guide structures at both ends; an inlet line for the ram air St to the heat exchanger may be gradually adapted from its initially circularly cylindrical section to an annular shape fitting the matrix; and thermal insulation can be provided.

Figure 9:
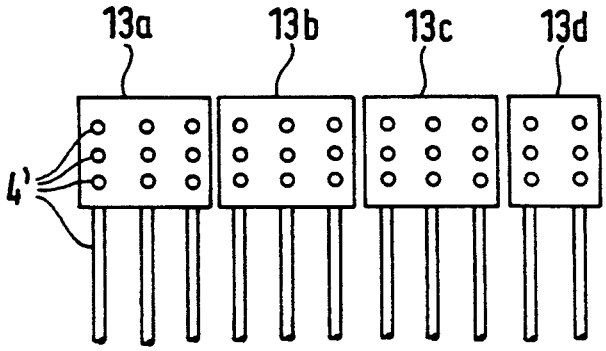
FIG. 9 is a sectional view taken along line 9—9 in FIG. 7 illustrating one embodiment of a spacer support.

FIG. 9 illustrates a variant of the spacer support in FIG. 2 in that oval, tubular body 13 is subdivided into a plurality of longitudinally spaced oval tubular bodies **13*a*, 13*b*, 13*c*, 13*d* one after the other parallel to the heat exchanger center line. The tubular bodies 13*a*–13*d* each communicate with respective groups of tubes 4', i.e. three rows and three columns in each body 13*a*–13*d***.

Figure 10:
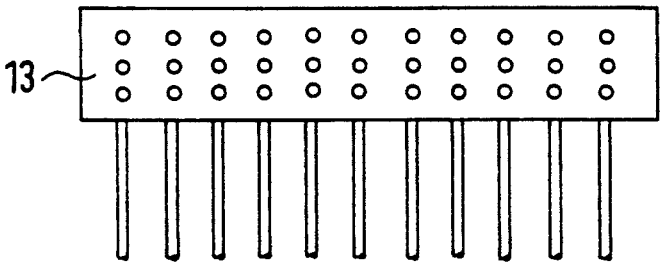
FIG. 10 is a sectional view taken along line 9—9 in FIG. 7 illustrating another embodiment of the spacer support.

In FIG. 10 an embodiment of the support tube 13 is similar to that in FIG. 2 (oval, tubular body 13) in combination with the annular matrix of FIG. 7. In FIG. 10 three rows of eleven tubes 4 are shown for each tubular body.

Figure 8:
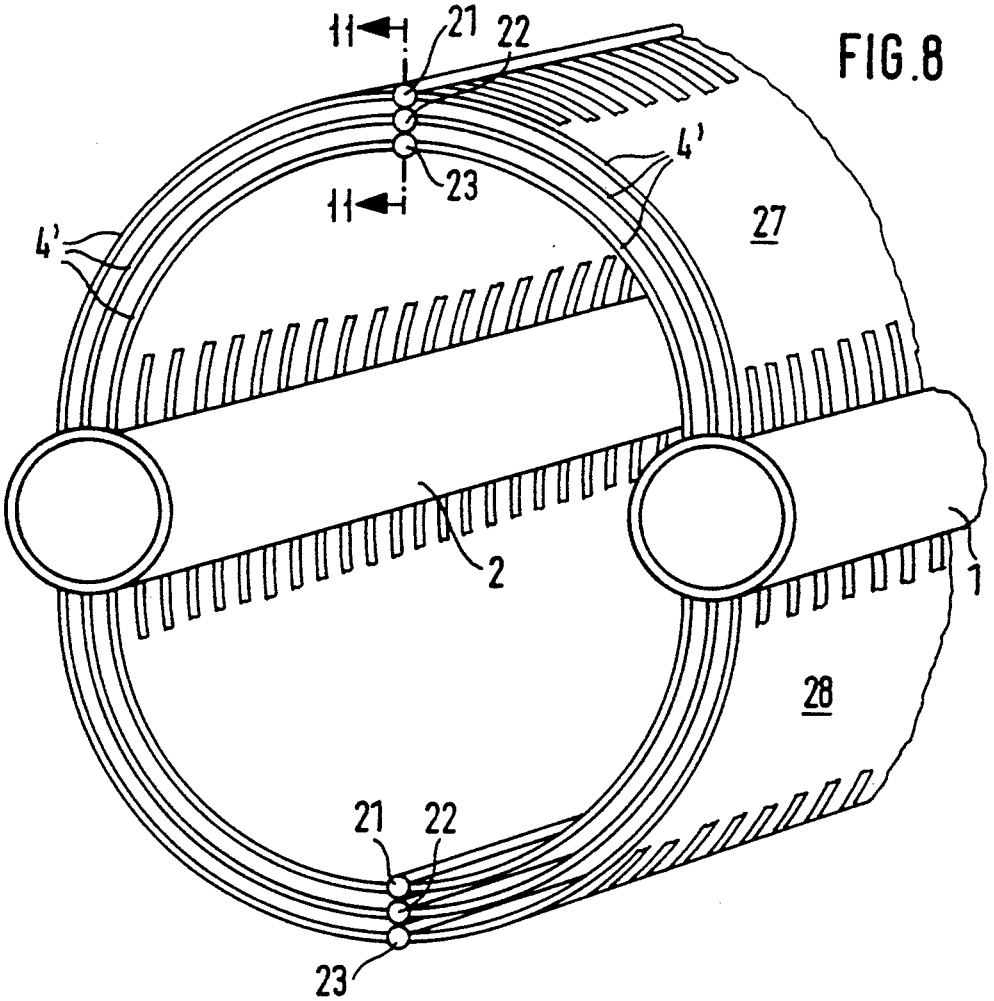
FIG. 8 is a diagrammatic perspective view of a variant of the heat exchanger in FIG. 7.
Figure 11:
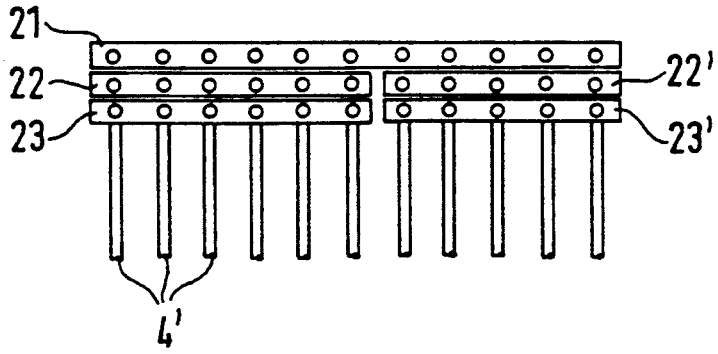
FIG. 11 is a sectional view taken along line 11—11 in FIG. 8.

FIG. 11 shows an arrangement of a spacer support similar to that in FIG. 5, in combination with an annular matrix as shown in FIG. 8. In FIG. 11, the spacer support differs from that according to FIG. 5, in that it employs cylindrical tubes 22 and 22' and 23 and 23', which are axially subdivided and spaced in the direction of the center line of the annular heat exchanger and are connected to associated rows of heat exchange tubes 4'. The spacer supports of FIGS. 3 through 6 can be used individually or in combinations with each other in the respective embodiments of the heat exchangers with an annular matrix according to FIGS. 7 or 8. It should also be noted that the heat exchanger design of FIG. 8 substantially corresponds to that of FIG. 7, so that the same components are designated by the same reference numerals.

Although the invention has been described in relation to specific embodiments thereof, it will become apparent to those skilled in the art that numerous modifications and variations can be made within the scope and spirit of the invention as defined in the attached claims.

What is claimed is:

1. A heat exchanger comprising first and second spaced manifolds in parallel arrangement respectively for the supply and discharge of a heat absorbing fluid, a matrix including bundles of spaced heat exchange tubes connected to said first and second manifolds for conveying the heat absorbing fluid therebetween, said bundles of heat exchange tubes extending into the path of flow of a hot fluid for heating said heat absorbing fluid in said tubes by heat exchange with said hot fluid, and spacer support means extending both transversely of at least one bundle of tubes of said tube matrix and parallel to said first and second manifolds for holding said bundle of heat exchange tubes in spaced relation, said spacer support means comprising a hollow body, hermetically sealed with respect to said hot fluid and subdividing said heat exchange tubes in said at least one bundle of heat exchange tubes into tube sections having opposingly facing tube ends, said tube ends providing a fixedly joined flow connection between the subdivided tube sections and the interior of said hollow body for causing said hollow body to be internally wetted and cooled by said heat absorbing fluid.

2. A heat exchanger as claimed in claim 1, wherein said hollow body includes opposed, facing walls, said tube ends of said sections of said heat exchange tubes being fixedly connected to said opposed, facing walls substantially in alignment with one another.

3. A heat exchanger as claimed in claim 2, wherein a plurality of said heat exchange tubes have the sections thereof opening in common into said hollow body.

4. A heat exchanger as claimed in claim 3, wherein said hollow body has an oval cross-section.

5. A heat exchanger as claimed in claim 3, wherein said walls of said hollow body include rectilinear portions which define a polygonal outline to which said ends of said tube sections of respective heat exchange tubes are connected.

6. A heat exchanger as claimed in claim 3, comprising partition means in said hollow body to divide the body into separate chambers, the sections of a plurality of said heat exchange tubes opening in common into respective chambers.

7. A heat exchanger as claimed in claim 3, wherein said hollow body has an oval cross-section with a major axis extending in the direction of flow of said hot fluid.

8. A heat exchanger as claimed in claim 2, wherein a plurality of hollow bodies are provided each for a respective group of said heat exchange tubes.

9. A heat exchanger as claimed in claim 8, comprising means coupling said hollow bodies together and providing relative sliding movement therebetween.

10. A heat exchanger as claimed in claim 9, wherein said means coupling said hollow bodies together comprises members respectively secured to said hollow bodies and providing a tongue and groove sliding connection therebetween.

11. A heat exchanger as claimed in claim 10, wherein each hollow body is elongated longitudinally and the tubes of the respective groups are connected in spaced relation along the length of the hollow body, said tongue and groove connection providing relative sliding movement of said hollow bodies in a transverse direction of the elongated bodies.

12. A heat exchanger as claimed in claim 9, wherein said manifolds are elongated longitudinally and said means which couples the hollow bodies together provides said relative sliding movement in a transverse direction relative to said manifolds.

13. A heat exchanger as claimed in claim 8, wherein said heat exchange tubes extend in rows and columns between said manifolds, the tubes in the rows being connected to the manifolds along the length thereof, said hollow bodies extending lengthwise of said manifolds.

14. A heat exchanger as claimed in claim 13, wherein a plurality of said hollow bodies are arranged lengthwise of the manifold and are connected to respective groups of heat exchange tubes in said rows.

15. A heat exchanger as claimed in claim 1, wherein said heat exchange tubes are curved along their length and define an annular arrangement connecting said first and second manifolds, a plurality of hollow bodies being provided at angularly spaced intervals in said annular arrangement.

16. Spacer support means connected to a matrix of heat exchange tubes of a heat exchanger to maintain the tubes of a heat exchanger in spaced relation and resist overheating by hot fluid flowing around the tubes and the spacer support means, said spacer support means comprising a body provided with openings for attachment thereto of sections of heat exchange tubes in spaced relation, said body being hollow and providing communication between the interior of said hollow body and said sections of said heat exchange tubes so that flow of a heatable fluid in said heat exchange tubes is conveyed form one section to another via said hollow body, said hollow body including opposed, facing walls, said sections of said heat exchange tubes having ends facing one another fixedly connected to said opposed, facing walls.

17. Spacer support means as claimed in claim 16, wherein a plurality of said heat exchange tubes have the sections thereof opening in common into said hollow body.

18. Spacer support means as claimed in claim 17, wherein said hollow body has an oval cross-section.

19. Spacer support means as claimed in claim 17, wherein said walls of said hollow body include rectilinear portions which define a polygonal outline to which sections of respective heat exchange tubes are connected.

20. Spacer support means as claimed in claim 17, wherein a plurality of hollow bodies are provided each for a respective group of said heat exchange tubes.

21. Spacer support means as claimed in claim 20, comprising means coupling said hollow bodies together for relative sliding movement therebetween.

22. Spacer support means as claimed in claim 21, wherein said means coupling said hollow bodies together comprises members respectively fitted on said hollow bodies and providing a tongue and groove sliding connection therebetween.

23. Spacer support means as claimed in claim 22, wherein each hollow body is elongated longitudinally and the tubes of the respective groups are connected in spaced relation along the length of the hollow body, said tongue and groove connection providing relative sliding movement of said hollow bodies in a transverse direction of the elongated bodies.

24. Spacer support means as claimed in claim 16, wherein a plurality of hollow bodies are provided each for a respective group of said heat exchange tubes.

25. A heat exchanger as claimed in claim 1, wherein said bundle of tubes of said matrix includes curved regions in which the heat absorbing fluid undergoes reversal of direction of flow of said heat absorbing fluid.

* * * * *